US008528998B2

(12) United States Patent
Leal

(10) Patent No.: US 8,528,998 B2
(45) Date of Patent: Sep. 10, 2013

(54) ADJUSTABLE DETENT RETENTION SYSTEM AND METHOD

(75) Inventor: Benjamin Sanchez Leal, Calexico, CA (US)

(73) Assignee: Accuride International, Inc., Santa Fe Springs, CA (US)

( * ) Notice: Subject to any disclaimer, the term of this patent is extended or adjusted under 35 U.S.C. 154(b) by 280 days.

(21) Appl. No.: 13/112,475

(22) Filed: May 20, 2011

(65) Prior Publication Data

US 2011/0291539 A1 Dec. 1, 2011

Related U.S. Application Data

(60) Provisional application No. 61/348,059, filed on May 25, 2010.

(51) Int. Cl.
*A47B 88/04* (2006.01)

(52) U.S. Cl.
USPC ..... 312/333; 312/334.44

(58) Field of Classification Search
USPC ..... 312/330.1, 333, 334.1, 334.7, 334.8, 312/334.11, 334.44, 334.46, 334.47, 319.1; 384/21, 22
See application file for complete search history.

(56) References Cited

U.S. PATENT DOCUMENTS 5,775,787 A 7/1998 Gasser
6,254,209 B1 7/2001 Parvin
6,402,274 B1 * 6/2002 Reis ..... 312/334.46
6,497,464 B1 12/2002 Cammack et al.
7,086,708 B2 8/2006 Tseng et al.
7,229,142 B2 6/2007 Lin
7,458,651 B1 * 12/2008 Radke et al. ..... 312/333
7,628,460 B1 12/2009 Huang
2006/0082267 A1 4/2006 Lin
2008/0303399 A1 12/2008 Huang et al.

OTHER PUBLICATIONS

International Search Report and Written Opinion, International Application No. PCT/US2011/000915, dated Nov. 14, 2011 (10 pages).

* cited by examiner

*Primary Examiner* — James O Hansen
(74) *Attorney, Agent, or Firm* — Pillsbury Winthrop Shaw Pittman LLP

(57) ABSTRACT

In a slide assembly, an adjustable detent mechanism enables the detent and, therefore, the holding force, between a slide member on a pull-out component and an opposite slide member to be adjusted based on the application and load conditions for the pull-out component. The adjustable detent mechanism may include a base having symmetrically-disposed detent arms and associated legs which interact with respective adjuster cams symmetrically disposed on an adjustment dial. The dial is co-axial with, and is received in, the base, and both are coupled to one of the slide members. The opposite slide member has two symmetrically-disposed retention tabs that interact with respective ones of the detent arms to adjust the holding force between the slide members. The dial's range of rotation may be defined by the interaction between a pin disposed on the base and a rotation restriction guide that is defined through an undersurface of the dial.

39 Claims, 10 Drawing Sheets

110
114

116

112

139

110
113
123
123
113

115

113
117

112
112
117
111

111a
116
121
121

115
117
113

111

119

113
115

130

138

133
132
137

135a
135

137

136

139

139

135
136
134
134a

ADJUSTABLE DETENT RETENTION SYSTEM AND METHOD

RELATED APPLICATION DATA

This application claims priority from Provisional Application Ser. No. 61/348,059, filed May 25, 2010, which is incorporated herein by reference in its entirety.

TECHNICAL FIELD

Aspects of the present invention relate generally to drawer systems and, more specifically, to systems and methods for adjustable and releasable retention of drawers and similar pull-out components in the closed position so as to enable selective and adjustable control of the outward pull forces of such pull-out components.

BACKGROUND

Conventional drawer slide construction generally includes a means to hold a closed drawer in position, such that the drawer does not unintentionally or inadvertently open, which could cause injury or damage. This is particularly important when drawer/cabinet structures are mobile, such as a cart, a tool box, a utility unit, furniture, etc. on wheels. Similarly, furniture, cabinets, toolboxes, racks, etc. which contain drawers supported by reciprocating slides may be placed on an uneven surface or floor. These situations could cause some tilt, sloping, or other conditions, whereby a drawer could inadvertently open by itself without any intentionally applied pull in the opening direction.

The conventional means to retain the drawer in the closed position, which is easily released when the drawer is pulled open, may be constituted, for example, by a frictional interface between an inner member of the slide (i.e., the drawer member) and a fixed rubber or polymer bumper located at the front or rear of the outer member of the slide (i.e., the cabinet member). These types of bumper designs are disclosed, for example, in U.S. Pat. No. 6,254,209 and U.S. Pat. No. 7,086,708.

These types of frictional fixed bumpers may work well when the drawer and cabinet structures are stationary or fixed in position, are on level ground, and are not mobile. Mobile applications, especially those with weight, such as tool boxes, or other rolling carts, tend to require selective detent holding forces to ensure that heavy loaded drawers remain closed when moved. One drawback of this is that, when the drawer is not heavily loaded, the high detent forces tend to require additional effort and/or cause other practical issues in opening and closing such a light-weight drawer.

An additional disadvantage of the frictional polymer detent interface is the consistency of the detent over time and use. Abrasion and wear of the interface (both in the opening and closing directions) tends to initially increase the pull force, then gradually subside as contact and wear may create a crease or groove in the rubber or polymer bumper. This, in turn, causes erosion and subtraction of material and contact interface from the mating interface component, which is generally a drawer member, without any means to adjust for this wear factor, and recapture the desired forces.

DETAILED DESCRIPTION

Figure 1:
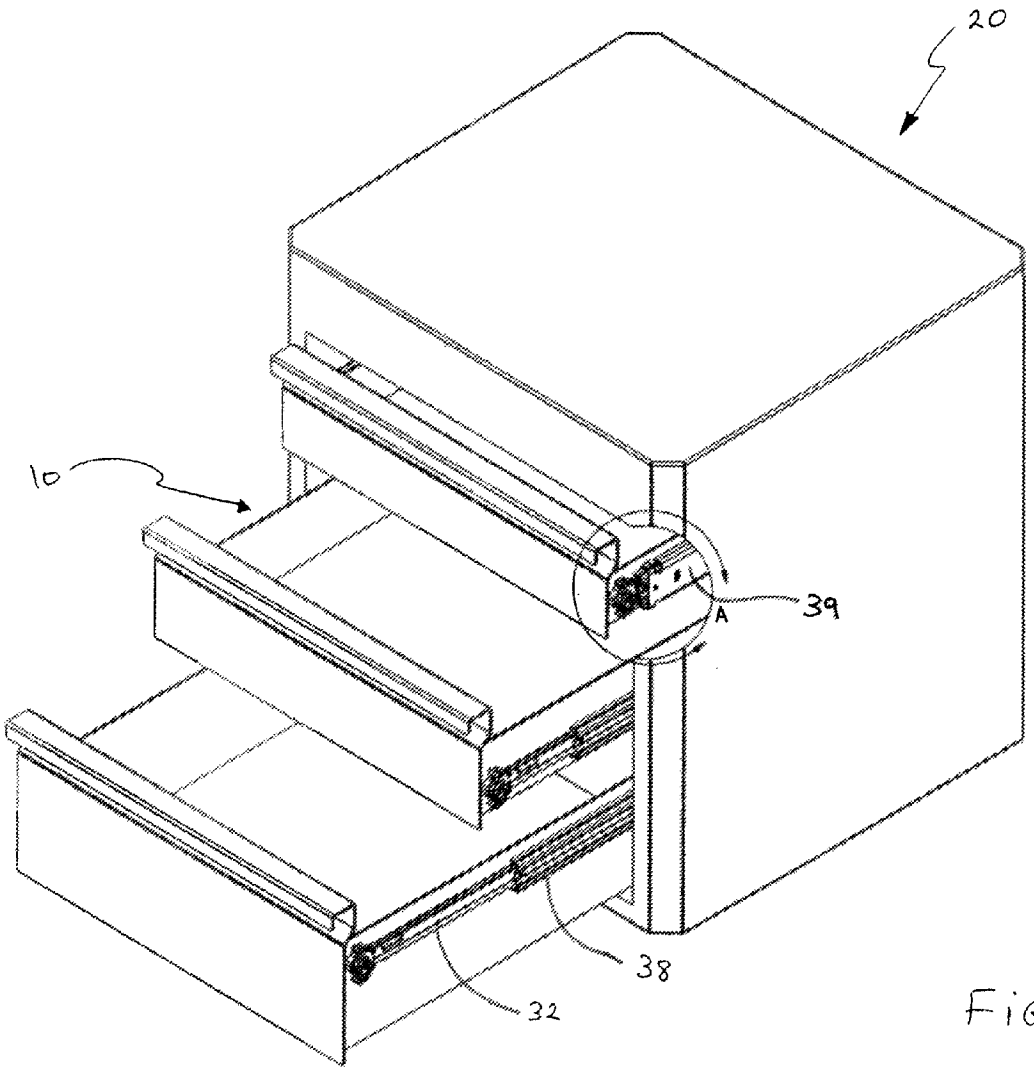
FIG. 1 is a perspective view of an embodiment of the present invention mounted in a typical cabinet system.

Embodiments of the invention are directed to adjustable detent retention systems (and associated methods) having an adjustable detent mechanism which enables an end-user to adjust the detent—and, therefore, the holding force between the drawer and cabinet members—in consideration of the application and drawer load conditions, thereby eliminating possible damage and/or personal injury and overcoming the above-mentioned shortcomings.

In addition, the systems according to embodiments of the present invention are economical to manufacture and simple to adjust and use. Considerations are made for instances of selected and customized adjustment, assembly, and attachment methods, all directed towards ease of operation in providing resistance to outward pull forces through coupling of a drawer or drawers and other pull-out components supported by a drawer slide in the closed position.

It is noted that, in the present description, reference is made to a "drawer" and, more specifically, to a cabinet drawer. However, this is for illustrative purposes only, and not by way of restriction or limitation, and the principles of the inventions described herein may be applied to other pull-out components and/or systems that include one or more pull-out components, such as, for example, office furniture, home furniture, kitchen appliances, general cabinetry (e.g., kitchen, garage, storage, etc.), tool boxes, automotive applications, etc. Where a drawer slide equipped with the embodiments of the present invention is described as being coupled to, or engageable with, one side of a drawer or cabinet, it is understood that, in embodiments of the invention, the drawer slide may be coupled to, or engageable with, the opposite side of the drawer/cabinet, or a pair of drawer slides, equipped with the embodiments of the present invention, may be coupled to, or engageable with, both sides of the drawer/cabinet.

It is also noted that descriptors such as "left hand" and "right hand" are used for ease of reference only, and do not restrict the structure, means for manufacturing, or operation of, or otherwise limit, embodiments of the invention.

As will be described in detail below, the adjustable detent mechanism of the present invention is coupled, or otherwise disposed, adjacent the front end of a drawer slide structure. As is known, a typical slide structure may include either two members (i.e., a drawer member and a cabinet member) or three members, wherein the latter is an intermediate slide member between the drawer and cabinet members. The purpose for locating the adjustable detent mechanism at or near the front of the drawer member is to allow easy access to the mechanism, in such a manner that the drawer does not have to be opened to its fully-extended position in order for the end-user to be able to perform the adjustment activities. In addition, the various embodiments of the present invention are designed to functionally operate without using any hand tools (e.g., screwdriver, wrench, etc.) to initiate and enable the adjustment features. The mechanism is completely assembled to the slides, and pre-set to a pre-determined detent position (middle detent position, for example) which can be easily adjusted (either up or down) by a simple grasp and rotation of an adjustment dial. Thus, it is not necessary for the end-user to conduct any additional installation tasks to operate the device.

The adjustable detent mechanism of the instant invention, therefore, presents a much-improved solution over that of the above-mentioned polymer detents. The inventive system is advantageous as, e.g., it allows the end-user to adjust or change levels of drawer holding force depending on requirements of each drawer, provides means to maintain forces with consideration to wear and usage, allows drawer holding and pulling forces to be adjusted (either higher or lower), has adjustable interface with two mating surfaces, adjacent to each other on opposite sides of the slide assembly, and is not influenced by the orientation of the slide when installed.

Figure 2:
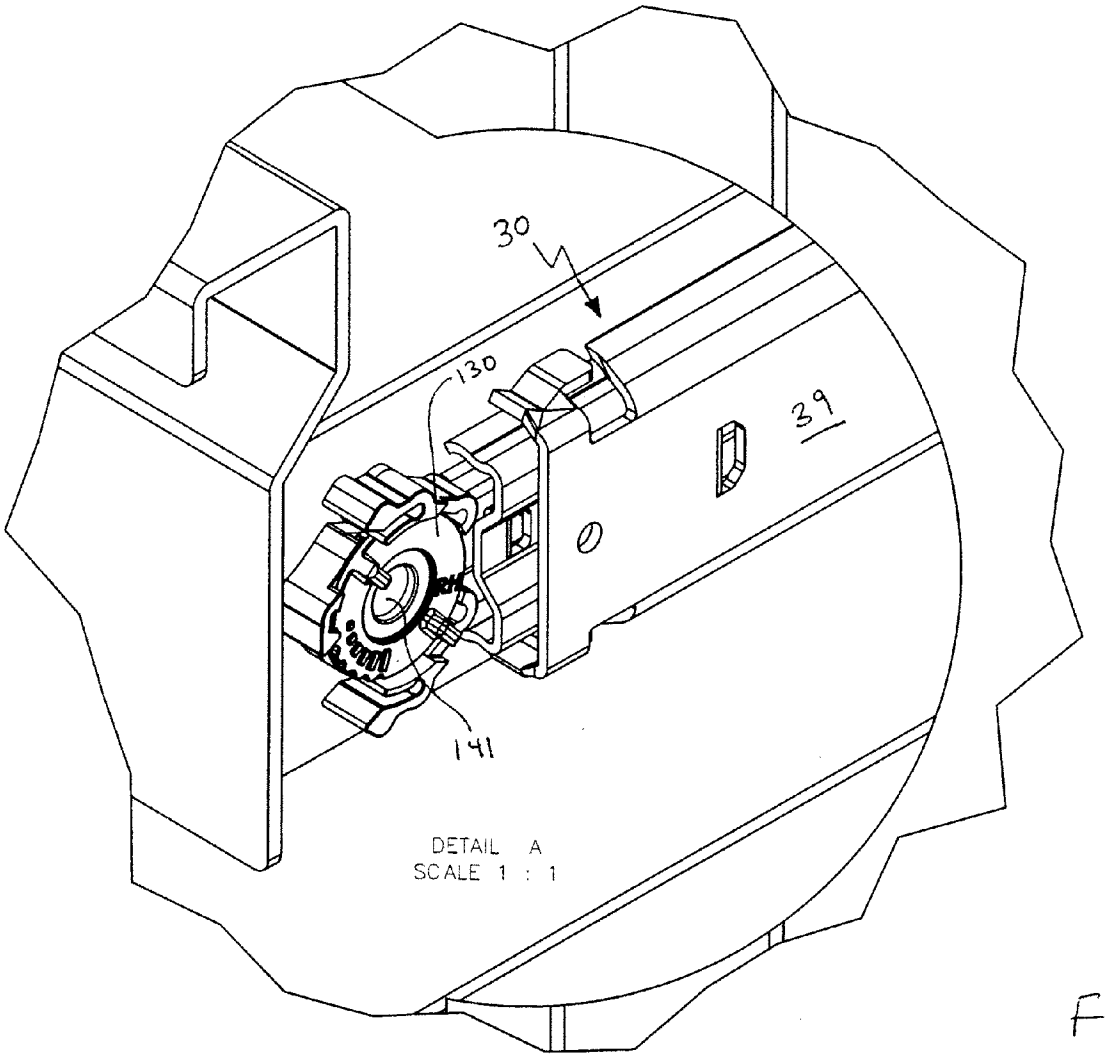
FIG. 2 is an enlarged view of region "A" shown in FIG. 1.
Figure 3:
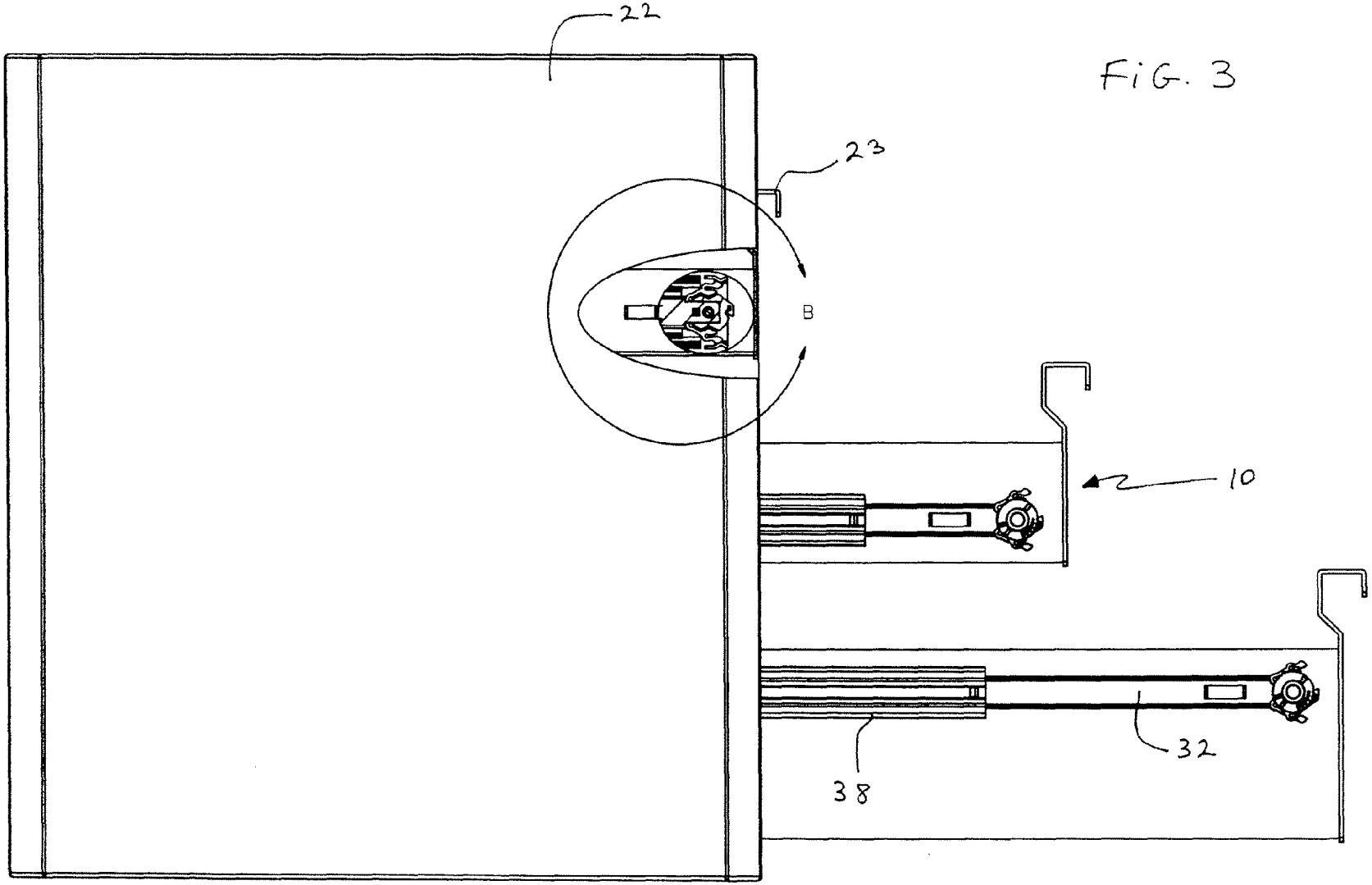
FIG. 3 is an opposite side view of the embodiment shown in FIG. 1.
Figure 4:
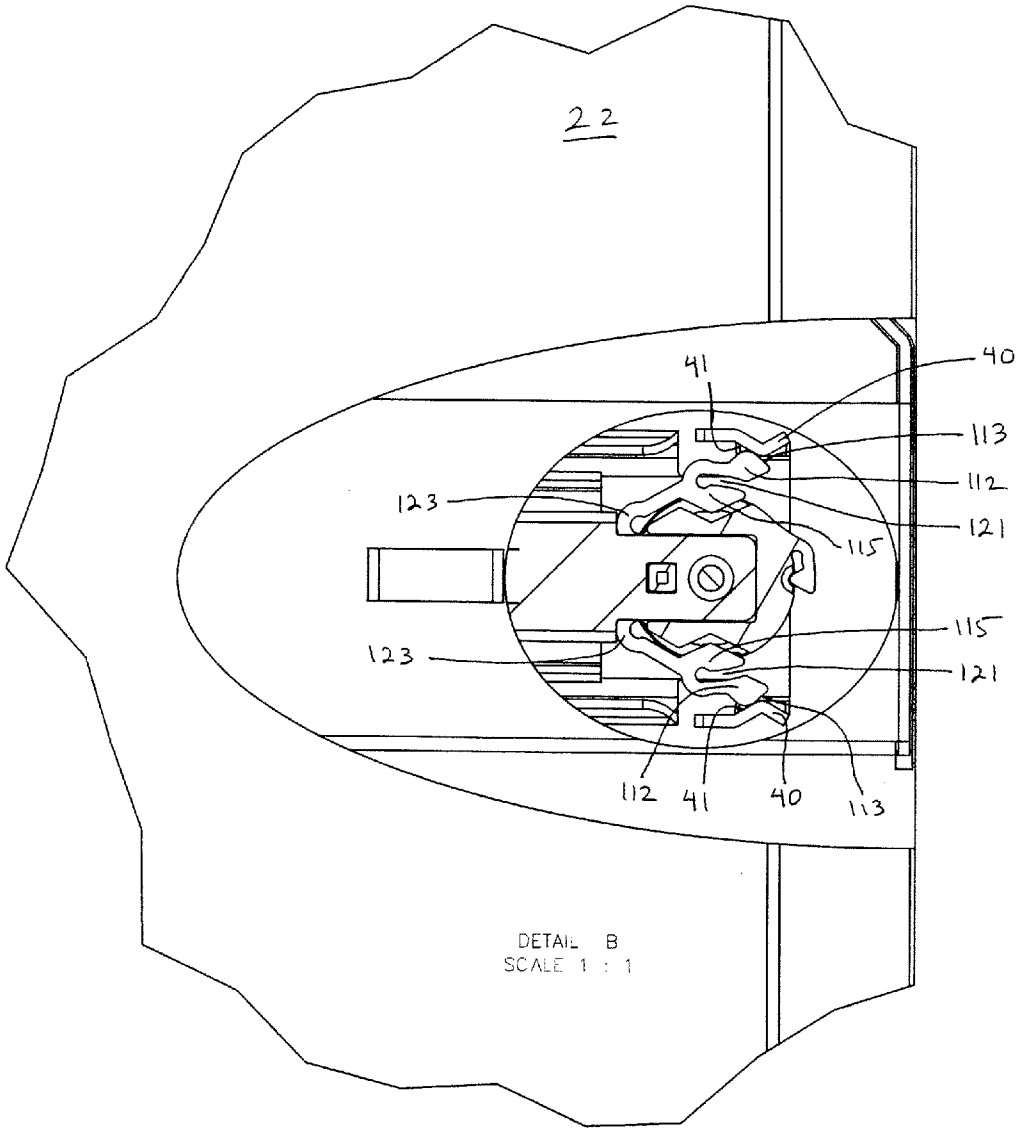
FIG. 4 is an enlarged view of region "B" shown in FIG. 3.

Specifically, as shown in FIGS. 1-4, embodiments of the present invention are directed to a system in which a drawer 10 moves in a linear path both forward and rearward, usually within a body 20, such as, e.g., a cabinet, using drawer slides. For purposes of the description, both the left hand and right hand slide assemblies 30 are engaged with the drawer/cabinet, the slide being exposed, with FIGS. 1-2 showing the right hand slide assembly 30 and FIGS. 3-4 showing the left hand slide assembly 30. In the embodiment shown, each slide assembly 30 includes a drawer member 32, an intermediate member 38, and a cabinet member 39. Coupled to the drawer member 32 is an adjustable detent mechanism 100 (see, e.g., FIGS. 5-7), which includes a base 110, an adjustment dial 130, and an attachment means which, in embodiments of the invention, may be a rivet 141. It is to be understood that an identical slide is disposed on the opposite side of the cabinet structure in each figure.

Figures 8A, 8B, 8C, 8D, 8E, 8F, 8G, 8H, 8I, 8J, 8K, 8L, 8M, 8N:
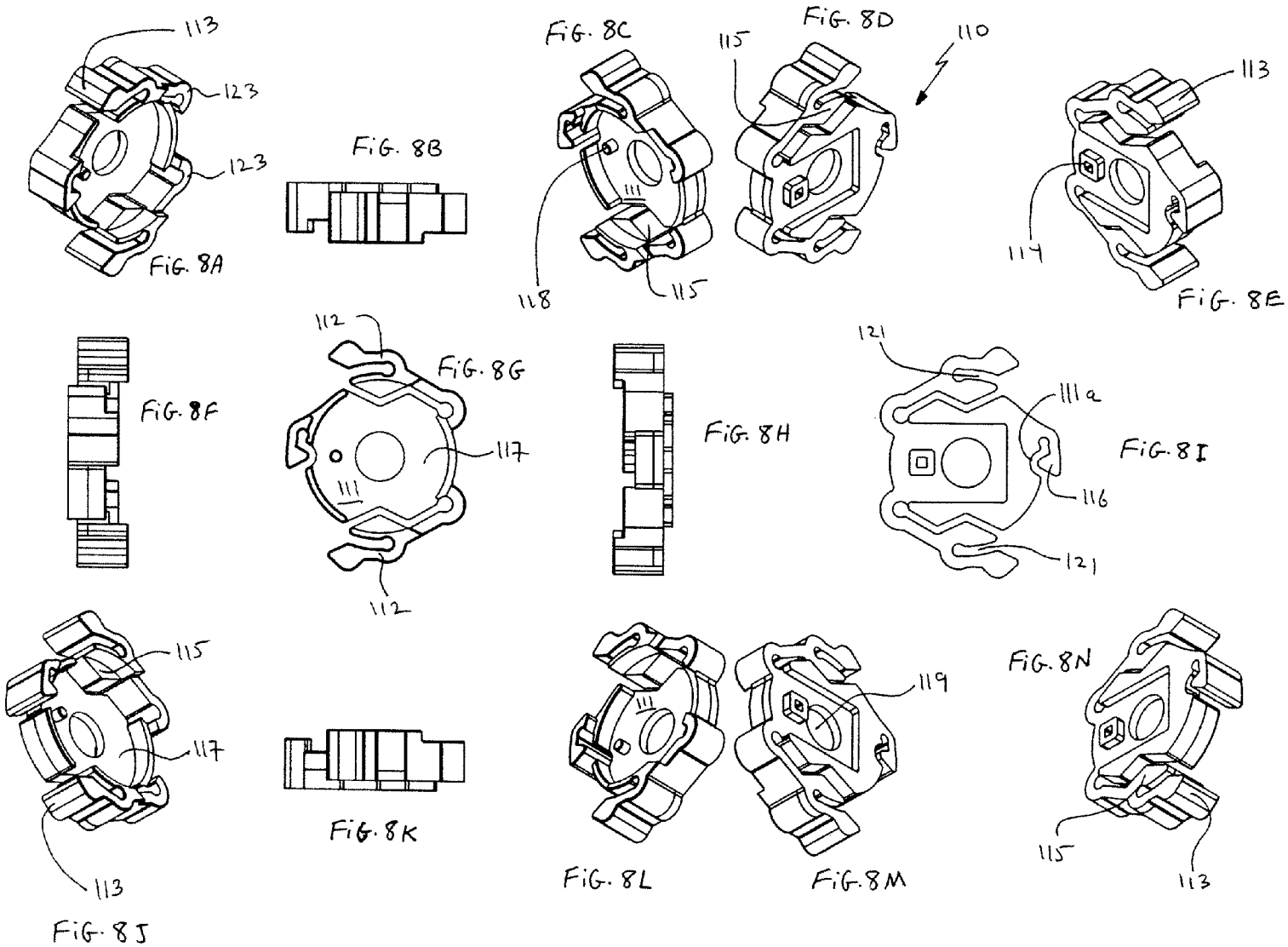
FIGS. 8A-8N show various views of a base in accordance with an embodiment of the invention.

As shown in FIGS. 4 and 8, integrated with the base 110 are symmetrically-disposed detent arms 112, each of which has a forward-sloping face 113. Each of the detent arms 112 also includes a leg 115 which points towards a base cavity 117 having a base floor 111. The base floor 111, in turn, defines a base aperture 119 through its central axis, a rotation restriction pin 118 on its upper surface, and a locating lug 114 on its lower (bottom) surface. The base 110 also includes an indexing pointer 116, with the base floor 111 including a notch 111*a* opposite the indexing pointer 116.

Figure 5:
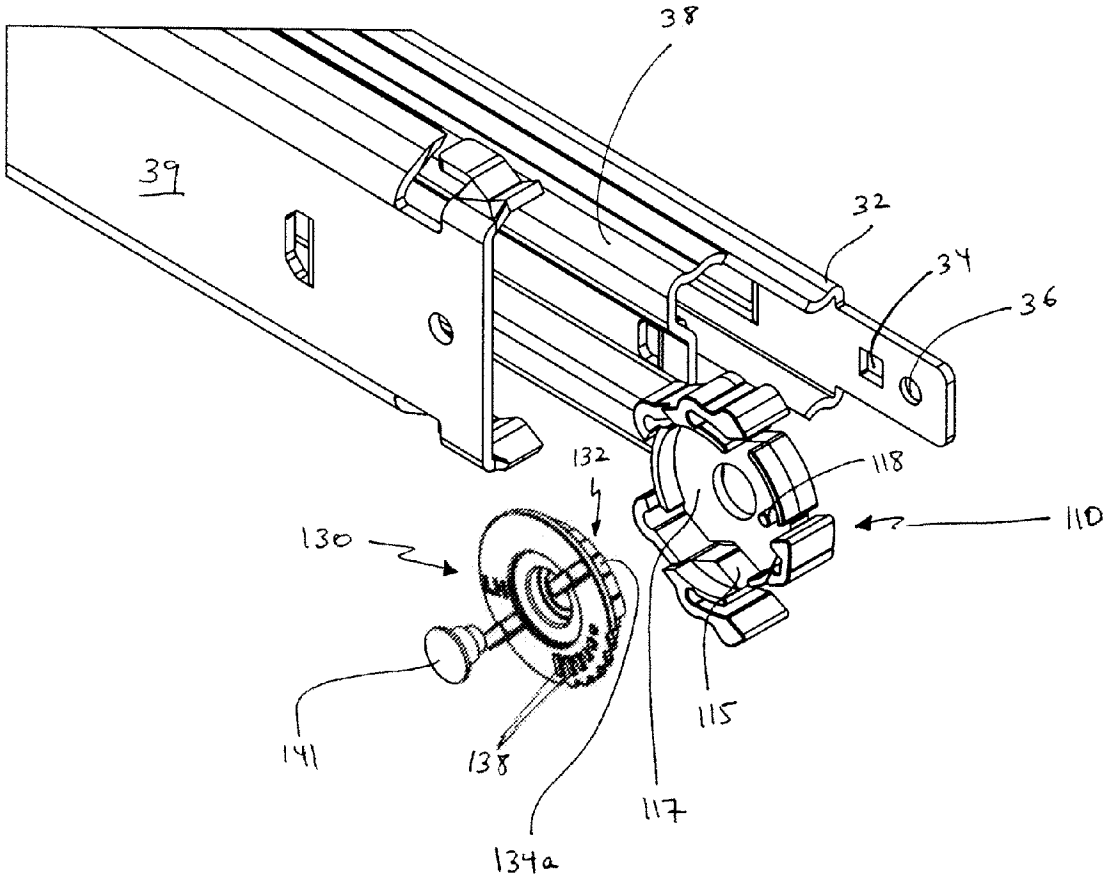
FIG. 5 is an exploded perspective view of an adjustable detent mechanism in accordance with an embodiment of the invention.
Figures 6A, 6B, 6C, 6D, 6E, 6F, 6G, 6H, 6I, 6J, 6K:
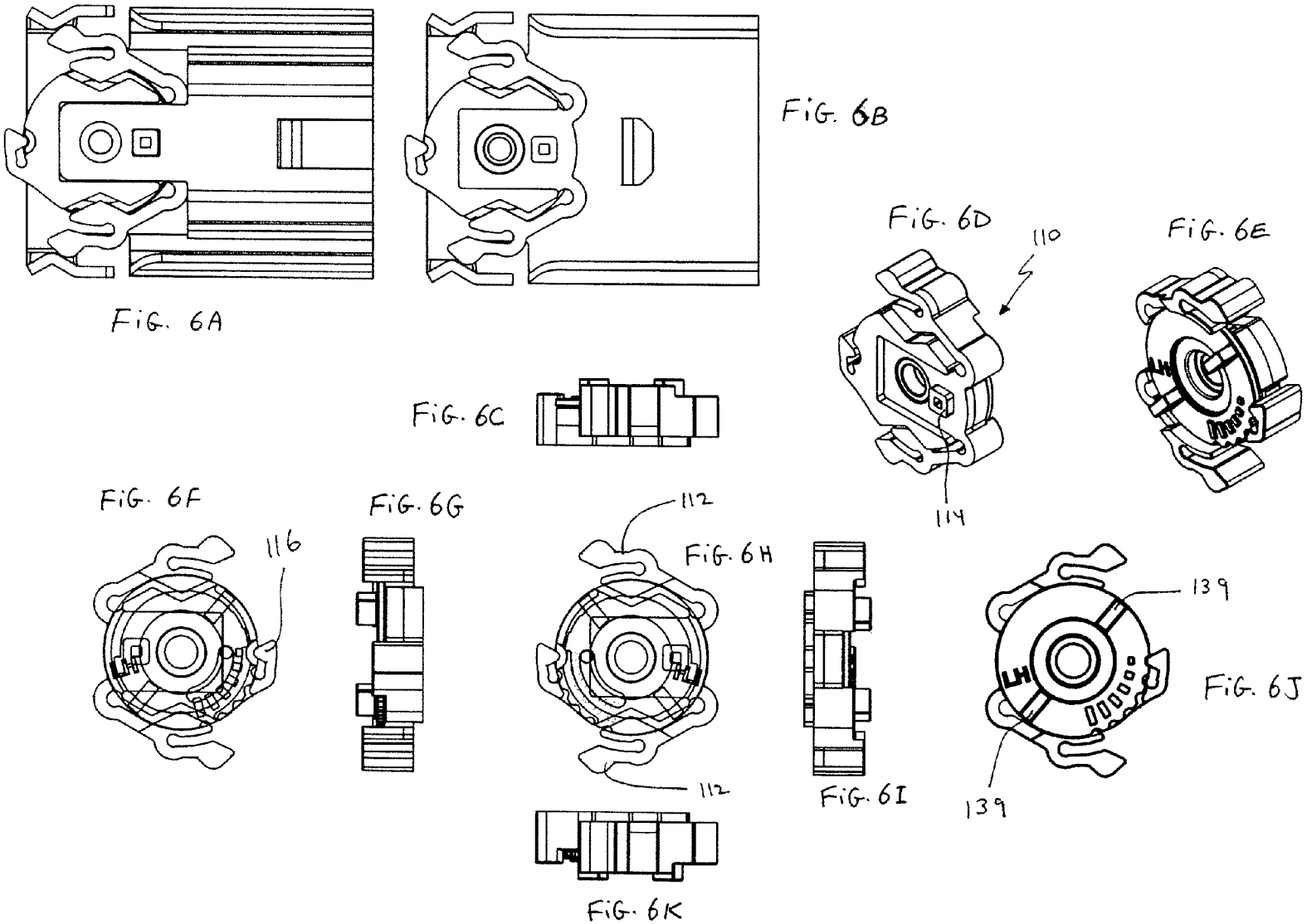
FIGS. 6A-6K show various views of a base-and-dial combination in accordance with an embodiment of the invention.
Figures 9A, 9B, 9C, 9D, 9E, 9F, 9G, 9H, 9I, 9J, 9K, 9L, 9M, 9N:
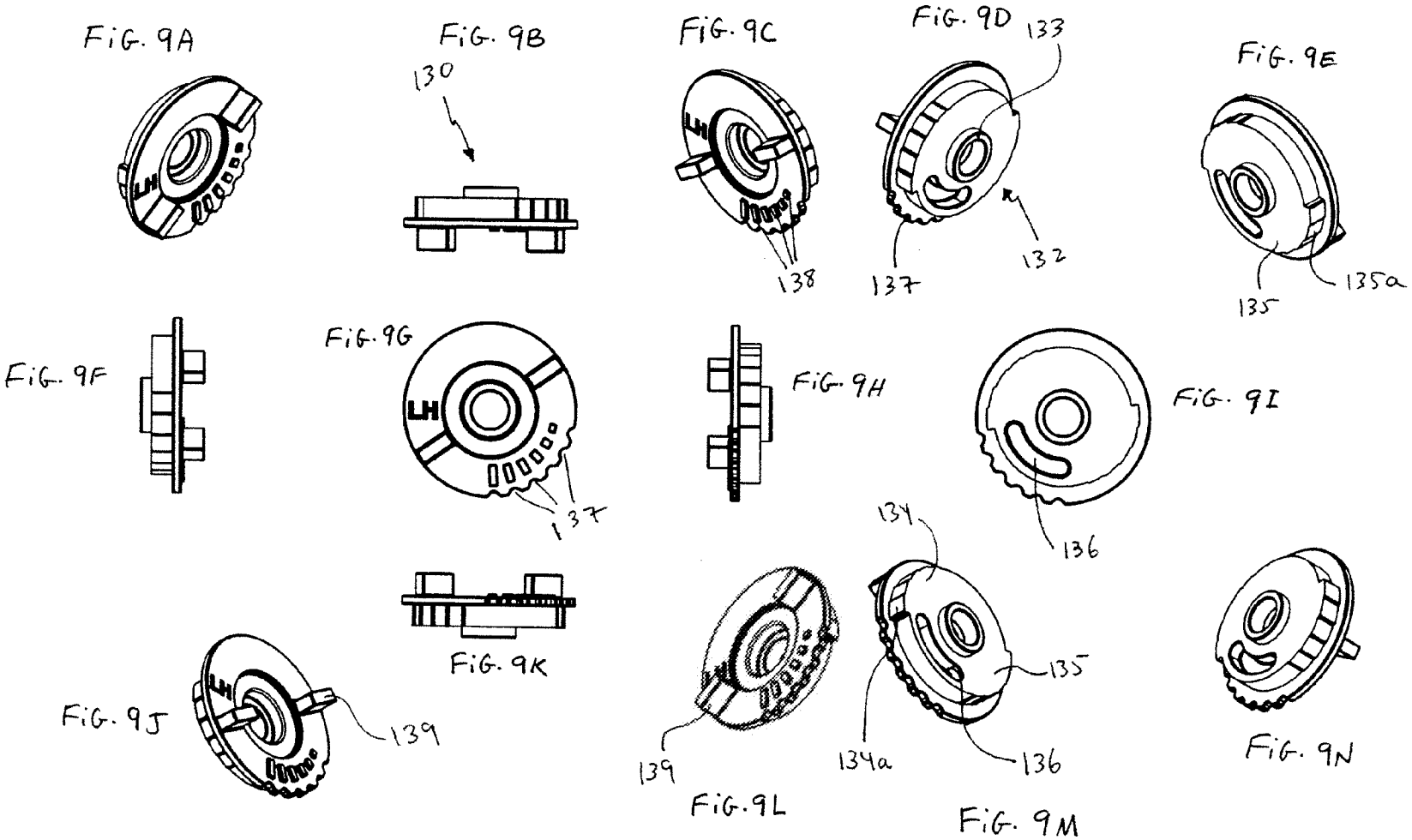
FIGS. 9A-9N show various views of an adjustment dial in accordance with an embodiment of the invention.

As shown in FIGS. 5, 6, and 9, within the cavity 117, the base 110 receives a bottom portion 132 of the adjustment dial 130, with the ring 133 being matingly received within the base aperture 119 of the base 110. Preferably, both the base 110 and the adjustment dial 130 are plastic or polymer injection molded components.

The bottom portion 132 of the adjustment dial 130 includes symmetrically-disposed adjuster cams 134, 135, and a slotted rotation-restriction guide 136. Each of the adjuster cams 134, 135, in turn, has cascading steps 134*a*, 135*a* around its respective periphery. With this construction, the interaction between the two legs 115 of the base 110 with the cascading steps 134*a*, 135*a* of the dial 130 causes the legs 115 to flex at their respective base points 123 which, in turn, causes the detent arms 112 to move in and out.

A perspective view of side face 22 of the cabinet 20 is shown in FIGS. 3 and 4. In FIG. 4, the adjustable detent mechanism 100 is shown in the closed and drawer detent holding position, with the forward sloping face 113 of detent arms 112 registered against the opposing rearward facing downward slope 41 of retention flanges (or tabs) 40 of outer member 39. As described below, these four mating surfaces—i.e., the two faces 113 and the two faces 41—provide the detent retention function of the present invention, with resistance to the displacement of the detent arms 112, by means of pull force resistance of drawer 10, being pulled by handle 23 as shown, e.g., in FIG. 3. The four mating surfaces, providing uniform and consistent resistance to the drawer pull forces is an advantageous improvement over devices that rely on a single interface contact for detent purposes, such as disclosed, e.g., in U.S. Pat. No. 7,229,142.

Each detent arm 112 is made of flexible material such that it can flex towards, and away from, a respective leg 115. More specifically, each of the detent arms 112 is displaced inwards by collapsing a slot (or web) 121 between each respective arm 112 and corresponding leg 115 (see, e.g., FIGS. 4 and 8). Depending on the dial setting (low-high), and the displacement of the legs 115 on the cascading steps 134*a*, 135*a* as noted above, the amount of collapse of the slot 121, i.e., the amount of flexing of the arms 112 toward the top of legs 115, may determine the range of detent readings.

For example, at the lowest setting of the dial 130, there is very little collapse of the slot 121, and most of the resulting detent force is primarily achieved via the frictional interaction between the two surfaces 113 and 41. As such, only a slight detent retention may exist. As the settings escalate, causing increased outward displacement of the detent arms 112, the detent retention that is achieved is still frictional, but it is increasingly a result of the resistance of the detent arms 112 to being collapsed while being forced through the space between the faces 41 of the outer-member retention tabs 40.

As the dial 130 is turned (increasing displacement), the distance between the arms 112 changes, with the displacement movement occurring at the base 123, as described previously. The detent resistance, however, actually depends on various factors affecting the design of the web 121, e.g., degree of flexibility of the material, thickness of the material, the web length, and so on, which may be customized during molding/manufacturing. Thus, for example, the length of the slot 121 may be reduced via an interchangeable core in the mold. Similarly, the base material may be changed, e.g., to a material that is more "stiff", while keeping within the material family for post mold shrink purposes. In addition, the width of the tabs 40 may be changed with a slide/feature forming tool modification.

It is noted that, the higher the detent, the more abrasion that exists due to restrictive/frictional interaction between the face 113 of each detent arm 112 and the slope 41 of each corresponding tab 40. Therefore, in applications where a larger degree of detent retention is desired, a plastic material—or material with similar characteristics—loaded with a lubricant (e.g., Silicon, Teflon, etc.) may be used to minimize material removal through abrasion.

The adjustable detent mechanism of the present invention, as described above, may be secured to drawer member 32, sliding within intermediate member 38, which in similar manner slides within outer member 39. The inventive adjustable detent mechanism, however, is not restricted, nor limited, to a three-member slide structure, and can be mounted within two-member slide structures as well. The aforementioned slide members, once assembled and mated together, and supported by means of ball bearings (not shown), create a drawer slide system suitable for supporting the linear travel of pull-out components within cabinet structures and systems.

An exploded view of a three-member slide assembly including an embodiment of the present invention is shown in FIG. 5. Locating lug 114 (see, e.g., FIGS. 6 and 8) registers in an aperture 34 of drawer member 32, with a rivet 141 piloted into, and mechanically secured through, a second aperture 36 of drawer member 32, thereby securing the assembled base and adjustment dial to the drawer member. It is noted that, although the locating lug 114 is shown as a square protrusion on the bottom surface of the base 110, it is to be understood that the lug, as well as the mating aperture 34 of drawer member 32, may be of various other matching shapes.

To assemble the detent mechanism, the adjustment dial 130 is positioned within cavity 117 of base 110, such that rotation restriction pin 118 is aligned with slotted rotation restriction guide 136 of dial 130. The two displacement legs 115 of base 110 come in contact with the cascading steps 134*a*, 135*a* of the dial to initially position the assembly. The cascading steps 134*a*, 135*a* are designed to displace the detent arms 112 into an interference contact with the rearward facing slopes 41 of the retention tabs 40 on outer member 39.

The indexing pointer 116 of base 110 registers in indentations (e.g., U-shaped or V-shaped notches) 137 of dial 130 to create a positive registration of the dial and its selected position. The positive registration is identifiable not only visibly, but also audibly, due to the registration "click" when moved to the desired and selected position. Corresponding graduated sized indicators 138, molded to the upper surface of dial 130, are positioned adjacent the indentations 137 to provide visual recognition to the end-user of the various (e.g., six) detent positions provided by embodiments of the present invention. It is to be understood that, when an end-user turns the dial 130 via the protrusions 139 such that the indexing pointer 116 is registered into one of the indentations 137, the smallest indicator alignment results in the lowest detent setting, with the largest indicator 138 aligned so as to result in the highest detent setting. The graduated sized indicators 138, shown in the figures as rectangular projections, may be substituted with circular "bubbles", ascending numbers, or sequential letters of the alphabet, and by no means limit or restrict the use of visual identifying characters for the positioning of the adjustable detent of the present invention. The graduated sized indicator set points segmented between the highest and lowest settings provide for customized selection of detent forces for the adjustable detent mechanism. At any given setting, the adjustment dial 130 is releasably "locked" into position via the interaction between the indexing pointer 116 and one of the indentations 137.

In operation, the inventive detent mechanism is coupled or secured to the drawer member 32 of the slide assembly, which travels a pre-determined length. When the slide is almost completely closed, detent arms 112 contact the retention tabs 40 of the cabinet slide member 39. Being flexible (e.g., made of plastic), the detent arms 112 deflect and bypass the tabs 40. The force to overcome the interference during the closing activity is less than the force to overcome the interference in the opening activity. This is due to the sloped angle differences of the detent arms. The angle is less in one direction of travel and greater in the other direction. Once the slide is fully retracted, and the drawer is fully closed, the detent arms (now on the inner side of the tabs) resist opening of the drawer 10, without a purposeful pull. The interference provided by the detent arms, aligned with the deflection restriction of the adjustment dial 130, when positioned provide the detent function intended of the invention, with the added capability of being adjustable to an upper and lower end of pull force. As described above, rotation of the adjustment dial 130 causes the arms 112 to move in and out via the interaction between the adjuster cams 134, 135 and the legs 115. The range of rotation of the dial 130, in turn, is defined by the interaction between the rotation restriction pin 118 and the slotted rotation restriction guide 136.

Figure 7:
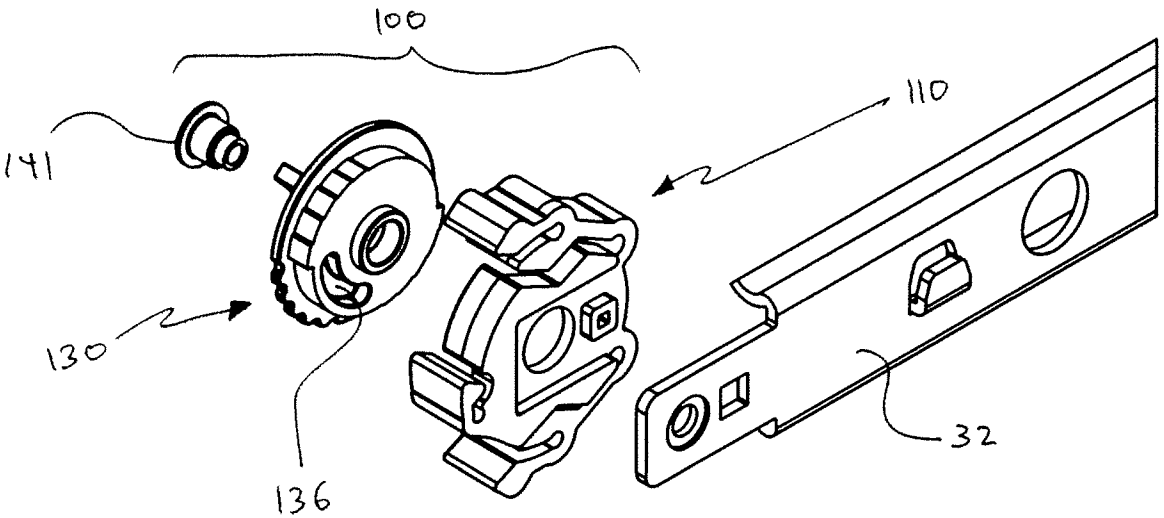
FIG. 7 is an exploded view of an adjustable detent mechanism in accordance with an embodiment of the invention.
Figure 10B:
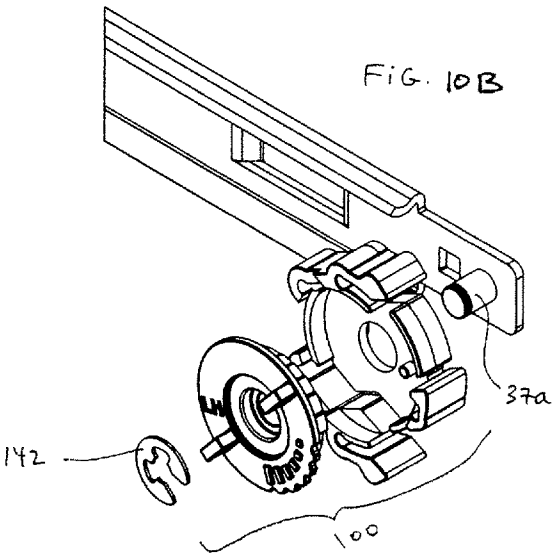
FIGS. 10A-10D show various alternatives for coupling an adjustable detent mechanism to a drawer member in accordance with embodiments of the invention.
Figure 10D:
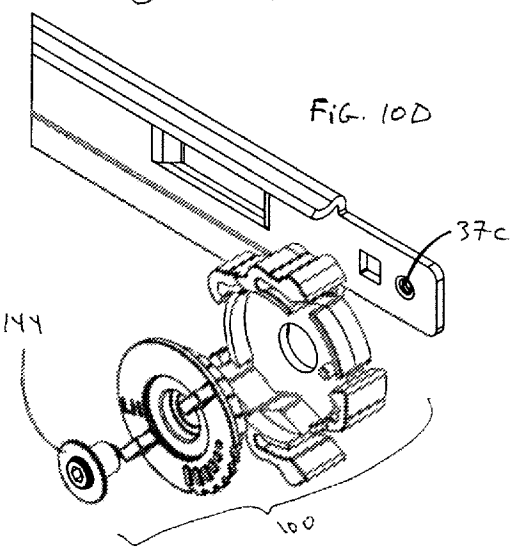
Figure 10A:
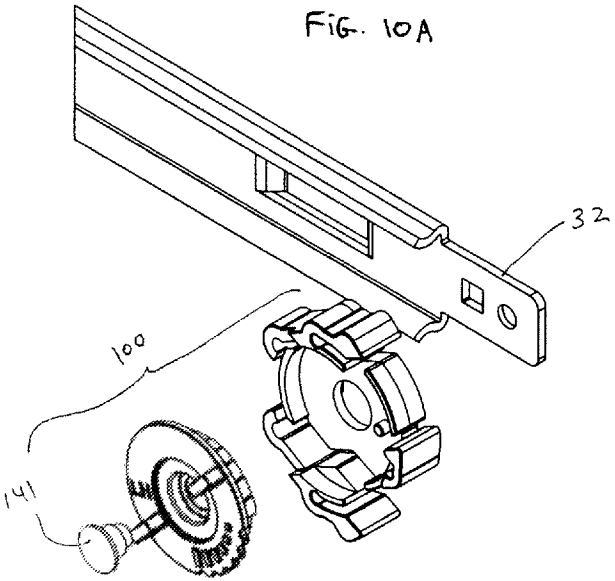

A simplified version of the exploded view of FIG. 5 is shown in FIGS. 7 and 10A, where a rivet 141 is used to couple the detent mechanism 100 to the drawer member 32. However, other fastening means may also be used. Thus, FIG. 10B shows an "E" style lock ring 142 that snaps on to a standing grooved pin 37*a* secured to the drawer member 32. The "E" style lock ring may be taken apart and reassembled very quickly with a pair of pliers and/or a flat screwdriver.

Figure 10C:
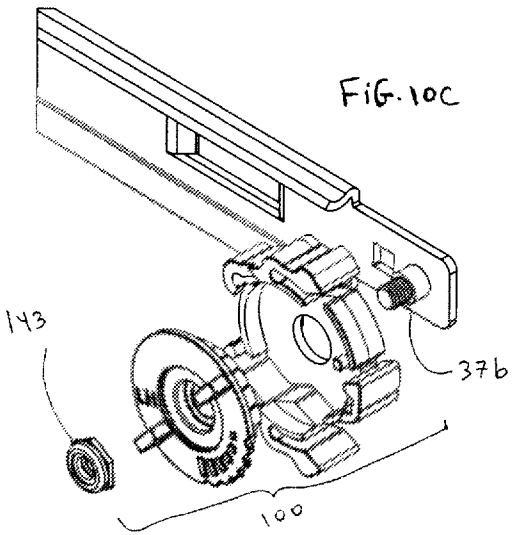

In FIG. 10C, a self-clinching threaded stud 37*b* is secured to the drawer member 32 and a lock nut 143 is used to hold the components in position for use. The nut 143 can be removed and re-assembled as many times as needed. In an alternative embodiment, as shown in FIG. 10D, a self-clinching nut 37*c* may be secured to, or integral with, the drawer member 32, and a shoulder screw 144 may be used to hold and position the components against the drawer member for use.

The above options allow for field replacement of components (e.g., the plastic components) in the event of damage or excessive wear. This type of field replacement does not require the user to remove the slide from either the drawer or cabinet.

While the description above refers to particular embodiments of the present invention, it will be understood that many modifications may be made without departing from the spirit and scope thereof. The presently disclosed embodiments are therefore to be considered in all respects as illustrative and not restrictive. In addition, it is understood that one or more of the components described herein in connection with a specific embodiment may be used in conjunction with one or more of the components described in connection with a different specific embodiment.

What is claimed is:

1. A slide assembly comprising:

a first slide member;

a second slide member, said second slide member being slidable with respect to the first slide member and including an upper retention tab and an opposing lower retention tab; and an adjustable detent mechanism coupled to the first slide member and comprising:

a base having a bottom surface disposed on the first slide member and first and second opposing detent arms disposed symmetrically about the base's central axis, wherein the first detent arm has a first leg integral therewith, the second detent arm has a second leg integral therewith, and the detent arms are configured to flex towards, and away from, said central axis; and an adjustment dial received co-axially and rotatably within said base, the adjustment dial including first and second opposing adjuster cams disposed symmetrically about the dial's central axis, wherein the first adjuster cam has cascading steps around its periphery that interact with the first leg, and the second adjuster cam has cascading steps around its periphery that interact with the second leg;

wherein the adjustment dial is operable such that, when the dial is rotated in one direction about its central axis, the adjuster cams interact with respective ones of the legs to flex the detent arms away from the central axis and towards said retention tabs, and when the dial is rotated in the opposite direction, the detent arms flex away from the retention tabs and towards the dial's central axis, thereby providing for adjustable frictional engagement between the detent arms and respective ones of the retention tabs; and wherein the base further includes a rotation restriction pin, the adjustment dial further includes a rotation restriction guide to receive the pin, and the range of rotation of the adjustment dial is defined by the interaction between the rotation restriction pin and the rotation restriction guide.

2. The slide assembly of claim 1, wherein the first slide member is a drawer member.

3. The slide assembly of claim 1, further including a third slide member, wherein the third slide member is an intermediate member that is disposed between and slidably coupled to said first and second slide members.

4. The slide assembly of claim 1, wherein the adjustable detent mechanism is detachably coupled to the first slide member.

5. The slide assembly of claim 1, wherein the adjustable detent mechanism further includes means for coupling the base and adjustment dial to the first slide member.

6. The slide assembly of claim 5, wherein the first slide member includes a transverse aperture and each of the base and the adjustment dial includes an aperture defined through the central axis thereof to accommodate said coupling means.

7. The slide assembly of claim 1, wherein the adjustment dial is operable without the need to separate the adjustable detent mechanism from the first slide member.

8. The slide assembly of claim 1, wherein each detent arm is spaced apart from its respective leg by a collapsible slot defined therebetween.

9. The slide assembly of claim 1, wherein the base further includes a locating lug on an undersurface thereof, and the first slide member includes a transverse aperture that is shaped to matingly receive said locating lug.

10. The slide assembly of claim 1, wherein the adjustment dial further includes a ring on an undersurface thereof, and the base includes an aperture defined through the central axis thereof to matingly receive said ring.

11. The slide assembly of claim 1, wherein the adjustment dial includes a plurality of notches around a portion of the periphery thereof, each said notch corresponding to a predetermined level of detent-arm flexure.

12. The slide assembly of claim 11, wherein the base further includes an indexing pointer that is configured to be selectively matingly received by each of said plurality of notches, thereby releasably retaining the adjustment dial in position for a selected level of detent-arm flexure.

13. The slide assembly of claim 11, wherein the adjustment dial further includes graduated sized visual indicators corresponding to said notches.

14. The slide assembly of claim 1, the adjustment dial further including means for rotating the dial clockwise and counter-clockwise.

15. The slide assembly of claim 1, wherein each said detent arm has a forward sloping face and each said retention tab has a rearward facing slope opposing said forward sloping face.

16. The slide assembly of claim 15, wherein, in a fully-retracted closed position, the forward sloping face of each of the first and second detent arms registers against the rearward facing slope of a respective retention tab.

17. The slide assembly of claim 16, wherein each said detent arm further includes a rearward sloping face which slopes at a lower angle than the forward sloping face.

18. The slide assembly of claim 1, wherein the base and adjustment dial are made of plastic or polymer material.

19. The slide assembly of claim 1, wherein the adjustment dial is disposed such that it is operable without the need to extend the first slide member to its fully-open position.

20. A slide assembly comprising:

a first slide member;

a second slide member, said second slide member being slidable with respect to the first slide member and including an upper retention tab and an opposing lower retention tab; and an adjustable detent mechanism coupled to the first slide member and comprising:

a base having a bottom surface disposed on the first slide member and first and second opposing detent arms disposed symmetrically about the base's central axis, wherein the first detent arm has a first leg integral therewith, the second detent arm has a second leg integral therewith, and the detent arms are configured to flex towards, and away from, said central axis, and wherein the base further includes a locating lug on an undersurface thereof, and the first slide member includes a transverse aperture that is shaped to matingly receive said locating lug; and an adjustment dial received co-axially and rotatable within said base, the adjustment dial including first and second opposing adjuster cams disposed symmetrically about the dial's central axis, wherein the first adjuster cam has cascading steps around its periphery that interact with the first leg, and the second adjuster cam has cascading steps around its periphery that interact with the second leg;

wherein the adjustment dial is operable such that, when the dial is rotated in one direction about its central axis, the adjuster cams interact with respective ones of the legs to flex the detent arms away from the central axis and towards said retention tabs, and when the dial is rotated in the opposite direction, the detent arms flex away from the retention tabs and towards the dial's central axis, thereby providing for adjustable frictional engagement between the detent arms and respective ones of the retention tabs.

21. The slide assembly of claim 20, wherein the adjustable detent mechanism is detachably coupled to the first slide member.

22. The slide assembly of claim 20, wherein the adjustable detent mechanism further includes means for coupling the base and adjustment dial to the first slide member.

23. The slide assembly of claim 22, wherein the first slide member includes a second transverse aperture and each of the base and the adjustment dial includes an aperture defined through the central axis thereof to accommodate said coupling means.

24. The slide assembly of claim 20, wherein the adjustment dial is operable without the need to separate the adjustable detent mechanism from the first slide member.

25. The slide assembly of claim 20, wherein the adjustment dial includes a plurality of notches around a portion of the periphery thereof, each said notch corresponding to a predetermined level of detent-arm flexure.

26. The slide assembly of claim 25, wherein the base further includes an indexing pointer that is configured to be selectively matingly received by each of said plurality of notches, thereby releasably retaining the adjustment dial in position for a selected level of detent-arm flexure.

27. The slide assembly of claim 25, wherein the adjustment dial further includes graduated sized visual indicators corresponding to said notches.

28. The slide assembly of claim 20, wherein each said detent arm has a forward sloping face and each said retention tab has a rearward facing slope opposing said forward sloping face.

29. The slide assembly of claim 28, wherein, in a fully-retracted closed position, the forward sloping face of each of the first and second detent arms registers against the rearward facing slope of a respective retention tab.

30. The slide assembly of claim 29, wherein each said detent arm further includes a rearward sloping face which slopes at a lower angle than the forward sloping face.

31. The slide assembly of claim 20, wherein the adjustment dial is disposed such that it is operable without the need to extend the first slide member to its fully-open position.

32. A slide assembly comprising:

a first slide member;

a second slide member, said second slide member being slidable with respect to the first slide member and including an upper retention tab and an opposing lower retention tab; and an adjustable detent mechanism coupled to the first slide member and comprising:

a base having a bottom surface disposed on the first slide member and first and second opposing detent arms disposed symmetrically about the base's central axis, wherein the first detent arm has a first leg integral therewith, the second detent arm has a second leg integral therewith, and the detent arms are configured to flex towards, and away from, said central axis; and an adjustment dial received co-axially and rotatably within said base, the adjustment dial including first and second opposing adjuster cams disposed symmetrically about the dial's central axis, wherein the first adjuster cam has cascading steps around its periphery that interact with the first leg, and the second adjuster cam has cascading steps around its periphery that interact with the second leg;

wherein the adjustment dial is operable such that, when the dial is rotated in one direction about its central axis, the adjuster cams interact with respective ones of the legs to flex the detent arms away from the central axis and towards said retention tabs, and when the dial is rotated in the opposite direction, the detent arms flex away from the retention tabs and towards the dial's central axis, thereby providing for adjustable frictional engagement between the detent arms and respective ones of the retention tabs;

wherein the adjustment dial further includes a plurality of notches around a portion of the periphery thereof, each said notch corresponding to a predetermined level of detent-arm flexure; and wherein the base further includes an indexing pointer that is configured to be selectively matingly received by each of said plurality of notches, thereby releasably retaining the adjustment dial in position for a selected level of detent-arm flexure.

33. The slide assembly of claim 32, wherein the first slide member is a drawer member.

34. The slide assembly of claim 32, wherein the adjustable detent mechanism is detachably coupled to the first slide member.

35. The slide assembly of claim 32, wherein the adjustment dial is operable without the need to separate the adjustable detent mechanism from the first slide member.

36. The slide assembly of claim 32, wherein each detent arm is spaced apart from its respective leg by a collapsible slot defined therebetween.

37. The slide assembly of claim 32, wherein the adjustment dial further includes graduated sized visual indicators corresponding to said notches.

38. The slide assembly of claim 32, wherein each said detent arm has a forward sloping face and each said retention tab has a rearward facing slope opposing said forward sloping face.

39. The slide assembly of claim 32, wherein the adjustment dial is disposed such that it is operable without the need to extend the first slide member to its fully-open position.

* * * * *